United States Patent [19]

Takemura

[11] Patent Number: 4,728,982

[45] Date of Patent: Mar. 1, 1988

[54] IMAGE FORMING APPARATUS

[75] Inventor: Yukio Takemura, Kawasaki, Japan

[73] Assignee: Canon Kabushiki Kaisha, Tokyo, Japan

[21] Appl. No.: 789,755

[22] Filed: Oct. 21, 1985

[30] Foreign Application Priority Data

Oct. 22, 1984 [JP] Japan ..... 59-221448

[51] Int. Cl.[4] ..... G03G 15/00

[52] U.S. Cl. ..... 355/3 R; 355/15; 355/67; 355/70

[58] Field of Search ..... 355/3 R, 1, 7, 67, 70, 355/15

[56] References Cited

U.S. PATENT DOCUMENTS

| | | | |
|---|---|---|---|
| 3,751,155 | 8/1973 | Liechty | 355/3 R |
| 4,008,954 | 2/1977 | Ogawa et al. | 355/3 R |
| 4,255,042 | 3/1981 | Armitage, Jr. et al. | 355/3 R |
| 4,497,565 | 2/1985 | Rutten | 355/3 R |
| 4,534,641 | 8/1985 | Gilliland et al. | 355/3 R |
| 4,552,447 | 11/1985 | Sagara et al. | 355/3 R |
| 4,561,761 | 12/1985 | Fox | 355/1 X |
| 4,576,464 | 3/1986 | Sakata et al. | 355/3 R |

FOREIGN PATENT DOCUMENTS 2011647 7/1979 United Kingdom .

*Primary Examiner*—R. L. Moses

*Attorney, Agent, or Firm*—Fitzpatrick, Cella, Harper & Scinto

[57] ABSTRACT

An image forming apparatus provided with a blank exposure device. The blank exposure device includes a plurality of light sources, each of which exhibits a light directivity. The light emitted from the directive portion is effective to electrically discharge the non-imaging area of the image bearing surface. Only adjacent to that side of each of the light emitting sources, such as light emitting diodes, which is nearer to the imaging area of the image bearing member, there is provided a light blocking member to block the light emitted from the marginal portion of the light-directive portion of the light emitting element.

20 Claims, 10 Drawing Figures

IMAGE FORMING APPARATUS

FIELD OF THE INVENTION AND RELATED ART

The present invention relates to an image forming apparatus, such as an electrophotographic apparatus and an electrostatic recording apparatus, and more particularly, to the image forming apparatus provided with an illumination device for illuminating a non-image forming area or non-imaging area of an image bearing member to dissipate electric charge thereof.

A recent image forming apparatus can be used with copy sheets having different sizes and/or can take a copy in different scales, providing a recorded image of an original in a different size.

On the surface of the image bearing member of the image forming apparatus, there are an image-forming area or imaging area which is defined as an area in which an image, to be transferred onto a transfer material, is constituted by a dark portion and a light portion and a non-image forming area or non-imaging area, adjacent to the imaging area, in which an image to be transferred does not and must not exist.

Since the entire surface of the image bearing member including the non-imaging area is usually subjected to a sensitizing operation prior to imagewise exposure, the non-imaging area retains the electric charge even after the imagewise exposure since the area is not exposed to light during imagewise exposure, although the area is not concerned with the image formation. Then, the non-imaging area is developed in the subsequent developing step to retain the toner. Even if the toner in the non-imaging area is not transferred to a transfer sheet, the toner is wastefully consumed, and various elements in the apparatus will be contaminated. To avoid those drawbacks, the non-imaging area is exposed to uniform light so that the electric charge there is removed before the development. This is called "blank exposure".

The area to be deprived of the electric charge may extend the entire width of the image bearing member or may be a lateral marginal area.

Hereinafter, the term "blank exposure" means to remove the electric charge by projecting light from a light source to the non-imaging area as defined hereinbefore, which in effect means the outside of the imaging area when the image is transferred to a transfer sheet, and can contain the area of a blank for erasing a frame or for separating images and the area of an image to be erased.

Conventionally use is made of a light source exhibiting directivity in the light projection, such as a light emitting diode (which will be called hereinafter "LED element"), as the light source for the blank exposure. FIG. 9 shows a conventional illumination device for illuminating the non-imaging area, wherein LED elements 23 and 231 are disposed opposed to the non-imaging areas B and C. When those LED elements are lit, the respective areas B and C are electrically discharged. Generally, an LED element has a transparent cylindrical portion 24 (241) from which only a slight amount of light is emitted and a convex end portion 25 (251) in the form of a lens, from which directive light of a high intensity is emitted which is effective to remove the charge. The latter portion will hereinafter be called "directive portion". The light emitted from the directive portion is effective to remove the electric charge, but the light emitted from the cylindrical portion is so slight that it is not effective to remove the charge.

However, inventors investigation has revealed that the boundary between the directive portion 25 (251) and the cylindrical portion 24 (241), and therefore, the boundary between the intensive light portion and the very slight light portion, are not so sharp, and that the light intensity gradually decreases toward the cylindrical portion 24 (241) in the boundary area of the directive portion. Therefore, the boundary is blurred.

Therefore, the imaging area and the nonimaging area defined by the blank exposure are not clearly distinctive, although it is desired that exactly only the non-imaging area is blank-exposed. In addition, the amount of exposure is short in the margin of the non-imaging area. Furthermore, the non-directive light 26 emitted from the cylindrical portion 24 (241) in the neighborhood of the boundary, is incident on the imaging area D, which can adversely affect the image formation.

FIG. 10 is a graph showing the distribution of light quantity applied to the surface of the image bearing member to be discharged in the image forming apparatus described above. The solid line curve represents the distribution of light provided by the LED element 23; and the broken line curve represent that provided by the LED element 231. The chain line curve indicates the distribution of the total amount of light provided by both of the LED elements. As will be understood from this graph, when a plurality of light emitting elements are used, a part of the light rays emitted from that one of the elements which is closest to the imaging area D can go into the imaging area D so that the image formation is influenced. As described, even when the directive light source is used, the clear distinction between the imaging area and the non-imaging area could not be provided, and the formed image is not good in the area adjacent to the boundary. Particularly, in the case of a variable magnification image forming apparatus wherein the non-imaging area extends differently depending on the magnification, and inter alia, a zoom image forming apparatus wherein the selectable magnifications are finely stepped, the influence of this is remarkable.

As for the prior art wherein the non-imaging area is exposed by an LED element, U.S. Pat. No. 4,255,042 has been issued, but this problem has not been solved thereby.

SUMMARY OF THE INVENTION

Accordingly it is a principal object of the present invention to provide an image forming apparatus wherein the non-imaging area is sharply bound.

It is another object of the present invention to provide an image forming apparatus wherein the charge removing in the non-imaging area is substantially uniform.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
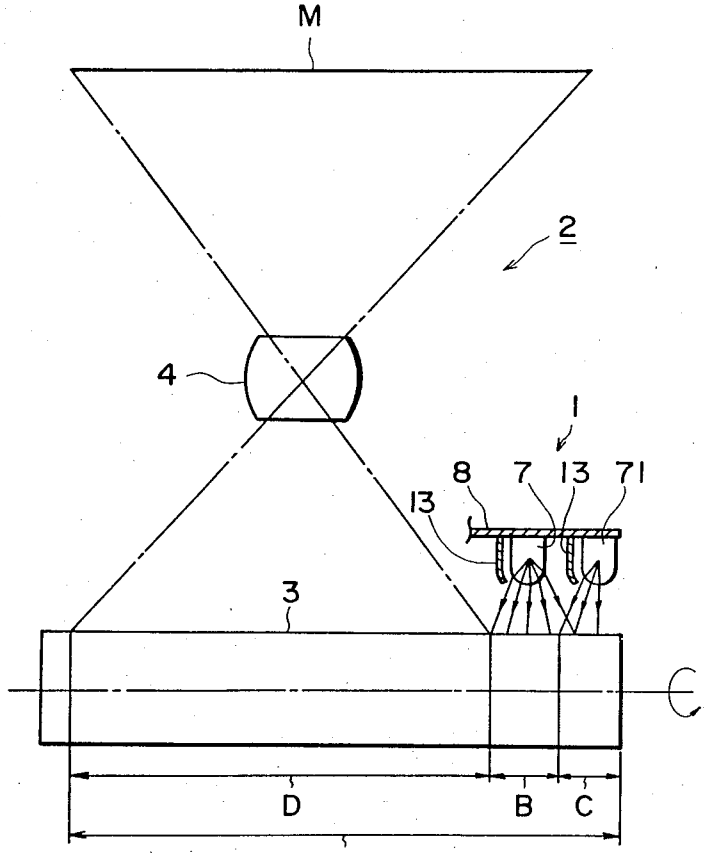
FIG. 1 is a somewhat schematic sectional view of a part of an image forming apparatus according to an embodiment of the present invention.

Referring now to FIG. 1, there is shown an image forming apparatus 2 provided with an illumination device 1, according to an embodiment of the present invention. The image forming apparatus 2 includes an image bearing member 3 in the form of a rotatable cylinder, and a lens assembly 4 which is effective to form an image of an original M to be copied on the image bearing member so as to form an electrostatic latent image.

In this apparatus, the reference character "A" indicates the entire image forming area; "D" is the imaging area; and "B" and "C" are non-imaging area adjacent to the imaging area D.

Figure 2:
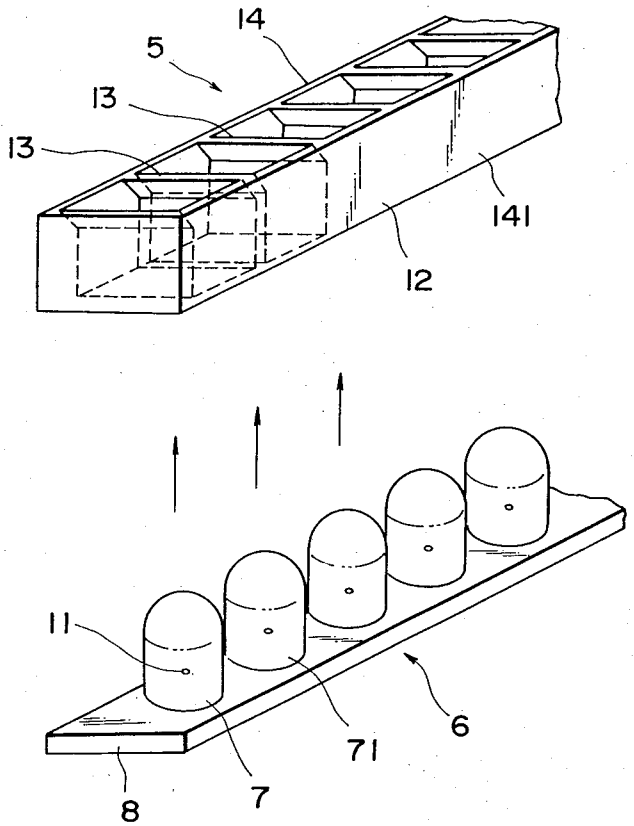
FIG. 2 is a partly broken perspective view of a part of the image forming apparatus according to the embodiment of the present invention.

The illumination device 1 is disposed opposed to the non-imaging areas B and C of the image bearing member 3, the illumination device 1 has its appearance as shown in FIG. 2 and comprises an LED array 6 and an accommodating member 5 for accommodating in a line the LED elements with light blocking plates. The LED array 6 comprises light emitting diodes 7 as the light sources.

The LED elements of the LED array 6 are fixed on the base plate 8 of a flat rectangular form in a line and at regular intervals. Each of the LED elements 7, 71 and so on includes a transparent cylindrical portion 9 and a directive portion 10 in the form of a convex lens at the free end portions thereof. In the Figure, a light emitting chip is indicated by a reference numeral 11.

Figure 3:
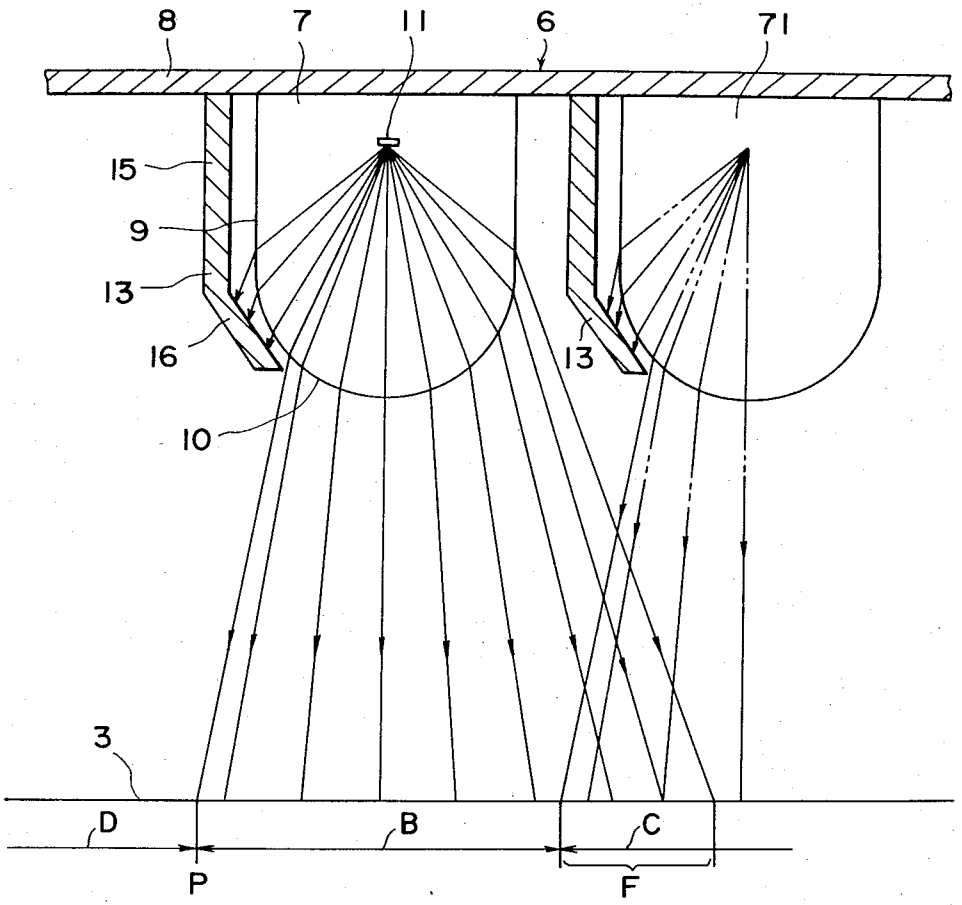
FIG. 3 is an enlarged sectional view of the illumination device according to an embodiment of the present invention.

The accommodating member 5 includes a frame in the form of a rectangular box corresponding in size to the base plate 8. The base plate 8 with the LED elements 7, 71 and so on is fixed to the accommodating member 5 as shown by the arrows in FIG. 2 with the respective LED elements being accommodated in the accommodating portions. The frame 12 has light blocking plates 13, one for each of the LED elements 7, 71 and so on. Each of the light blocking plates or members 13 is disposed at such a side of the associated LED element as is nearer to the imaging area D when the illumination device is mounted in place adjacent to the image bearing member 3. The light blocking plates 13 are fixed to the opposing side plates 14, 141 of the frame 12 at the regular intervals in the direction parallel to the axis of the image bearing member 3. As best seen in FIG. 3, each of the light blocking plates 13 has a perpendicular portion 15 parallel to the cylindrical portion 9 of the LED element 7 and an inclined portion 16 extending from the perpendicular portion 15 and inclining toward the directive portion 10 of the LED element 7 in the form of a convex lens. The light blocking plate 13 does not interfere with the light directing away from the imaging area D due to the inclination of the light blocking plate 13 for the adjacent LED element. Therefore, the adjacent LED elements can be disposed closely to each other.

The side plates 14, 141 not only accommodate the LED elements but also may block or limit the light in the direction of movement of the image bearing member surface, in the same manner as by the light blocking element 13 which will be described hereinafter, the light being emitted from the directive portion of the LED elements.

In operation, the illumination device of this embodiment functions as follows. As shown in FIG. 3, most of the light rays emitted from the light emitting chip 11 of the light emitting diode element 7 reach the image bearing member 3 so as to apply onto the non-imaging area B and C. However, a part of the light rays emitted from the directive portion to the imaging area D (lefthand side in the Figure) is blocked by the light blocking plate 13 and does not reach the imaging area D. Here, the material of the light blocking plate 13 is rubber in this embodiment which is black in color so that the light incident on the inside surface of the inclined portion 16 is not reflected but is absorbed. In the part F of the non-imaging area which corresponds to the middle of the adjacent light emitting elements 7 and 71, the light is applied superposedly from both of the light emitting diodes 7 and 71.

The light emitted from the light directive portion toward the imaging area side is blocked by the blocking plate 13, so that the illuminated area and the non-illuminated area are clearly distinct from each other at the boundary P between the imaging area and the non-imaging area. Since the illuminated area receives the large quantity of light from the light directive portion of the LED element, uniform charge removal is possible.

The light emitted from the LED element 7 and inclined away from the imaging area is superposed with the light from the LED element 71, whereby a sufficient quantity of light can be obtained in the middle part F between the LED element 7 and LED element 71. Therefore, the possibility is eliminated that the quantity of light is not sufficient in the neighborhood of the middle between the adjacent LED elements due to a positional error of the LED elements.

Since the LED element has directivity in the light projection, the light emitted from the directive portion away from the imaging area directly reaches the non-imaging area at the side remote from the light blocking plate 13, and therefore, there is no possibility that the light goes into the imaging area by reflection. For this reason, the boundary P between the imaging area and the non-imaging area can be made sharp.

Figure 5:
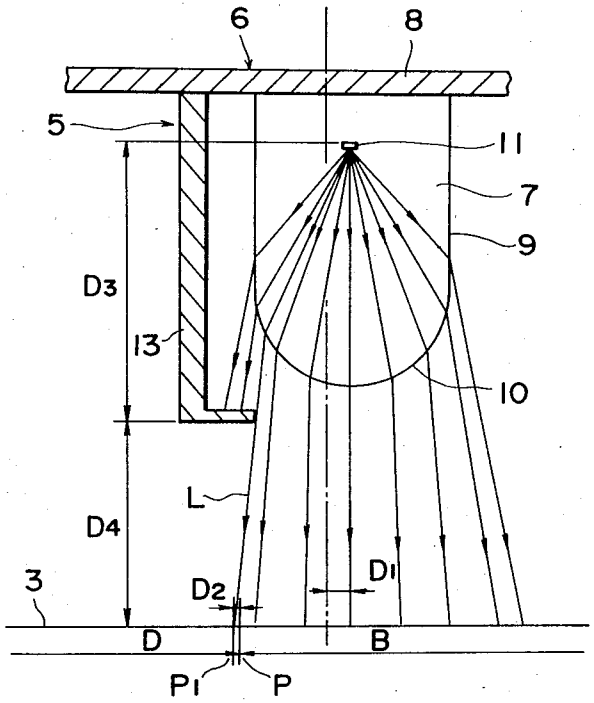
FIGS. 4 and 5 are sectional views illustrating an illumination device according to another embodiment of the present invention.
Figure 4:
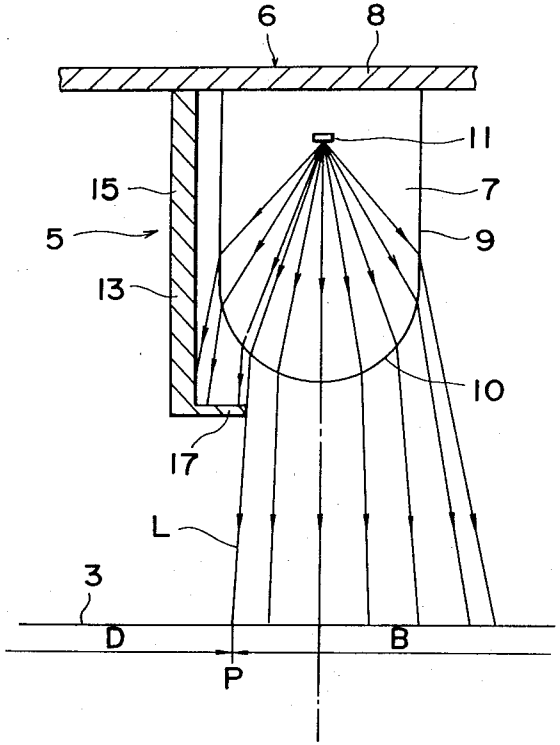

FIGS. 4 and 5 are sectional views illustrating the behavior when there is a positional error of the LED elements. Generally, a single element of the light emitting diode is small in size, and therefore, some positional error can occur when a plurality of such elements are disposed in a line, and it is difficult to increase the positional accuracy. In FIG. 4, the light blocking plate 13 has a perpendicular portion 15 extending along the LED element 7 and beyond the LED element 7, and the light blocking plate 13 is provided with a horizontal portion 17 extending from the perpendicular portion 15. Such a horizontal portion 17 is effective to block the light emitting from the more central portion of the directive portion 10 of the LED element. FIG. 4 shows the LED element 7 which is correctly positioned at a reference position with respect to the image bearing member 3. In this state, the light rays L barely allowed to reach the photosensitive member 3 are incident thereon at the boundary P between the imaging area D and the non-imaging area B.

In FIG. 5, it is assumed that the LED element 7 is offset to the right by a distance $D_1$ relative to the accommodating member 5. The light emitting position of the LED element 7 changes by the same amount. However, the above-described light rays L incident on the boundary P in the FIG. 4 position, are away from the boundary P and are incident at the position $P_1$ which is distant from the boundary P by $D_2$, which, however, is smaller than the distance $D_1$, since the light rays L are limited by the light blocking plate 13. The distance $D_2$ is determined on the basis of the distance $D_3$ between the light emitting chip 11 and the free end of the light blocking plate 13 measured in the direction perpendicular to the surface of the image bearing member 3 and the distance $D_4$ between the free end of the light blocking plate 13 and the surface of the image bearing memer 3, as follows:

$$D_2=(D_4/D_3)\times D_1$$

Accordingly, if the level of the free end of the light blocking plate 13 is so determined that the distance $D_3$ is larger than the distance $D_4$, the tolerable positional error of the LED element 7 may be larger with the result of the same or smaller offset of the position of the boundary P as compared with the positional error of the LED element 7. Therefore, it is not necessary to enhance remarkably the positional accuracy of the LED elements as in the conventional device, and it is still possible that the boundary between the imaging area D and the non-imaging area B can be made sharp. The description in this respect has been made with the light blocking plate 13 having a perpendicular portion 18 and the horizontal portion 17, but it will be readily understood that the influential distances are the distances $D_3$ and $D_4$, and therefore, that this applies to all of the embodiments of the present invention.

Additionally, as the description has been made with the positional error of the LED element, it will be appreciated that the same applies to the case where the light directive portion 10 of the LED element 7 is offset in the direction parallel to the axis of the image bearing member 3, for example.

Figure 6:
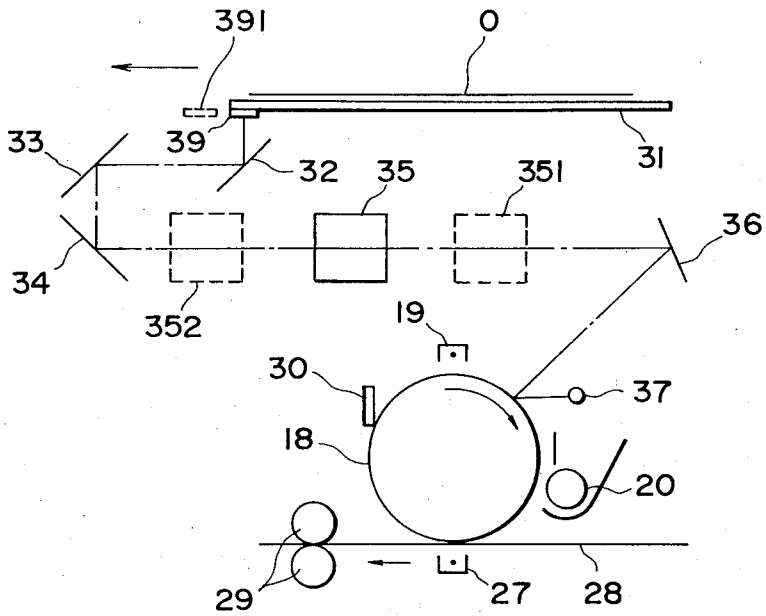
FIG. 6 is a sectional view of an image forming apparatus with a variable magnification function.

FIG. 6 illustrates another embodiment of the present invention directed to a copying apparatus having a function of variable magnification, and more particularly a zooming function. A drum 18 has an electrophotographic photosensitive layer around the surface thereof and is rotatable in the direction indicated by an arrow. The photosensitive drum 18 is first uniformly electrically charged for sensitization by a charger 19 and then slit-exposed to a light image of the original so that a latent image is formed on the photosensitive member. The latent image is then developed by a developing device 20 into a toner image. The toner image is transferred to a copy sheet 28 by a transfer charger 27. The copy sheet 28 is conveyed to the couple of fixing rollers 29, where the toner image is permanently fixed on the copy sheet. The drum 18 is cleaned by a cleaning blade 30 after the image transfer and is made ready for the next copying process.

The original O to be copied is supported on a platen glass 31, which is movable in the direction of an arrow in synchronism with rotation of the drum 18, so that the original O is scanned, and the image thereof is projected through a slit to the surface of the photosensitive drum 18. More particularly, the light reflected by the original O is reflected by the mirrors 32, 33 and 34 in this order and is transmitted through a lens 35, and then reflected by a mirror 36, whereafter it is incident on the surface of the drum 18. After completion of the scanning of the original, the platen glass 31 moves in the opposite direction to the position shown in the Figure (home position). The speed of the platen glass 31 in the forward direction, that is, the original scanning speed is the peripheral speed of the drum 18 divided by the copying magnification. The lens 35 is a zoom lens, and therefore, the copying magnification can be changed substantially continuously. When the magnification is the unit one, the lens 35 is disposed in the position shown by the solid line, but upon a reduction copy, it is placed at the position shown by a reference 351, for example, and is placed at a position indicated by a refernce 352, for example, upon enlargement copy. When the copying magnification is to be changed, the lens 35 is shifted to the position corresponding to the selected magnification, and the focal length of the lens 35 is also changed to the one corresponding to the selected magnification.

An illumination device 37 is disposed close to the drum 18. The illumination device 37 is located between the primary charger 19 and the developing device 20. For example, it is disposed at the position where the photosensitive drum 18 is exposed to the light image of the original. This positioning applies also to the foregoing embodiments. The illumination device 37 applies light to the non-imaging area of the photosensitive drum 18 to dissipate the electric charge applied to that area by the charger 19.

Figure 7:
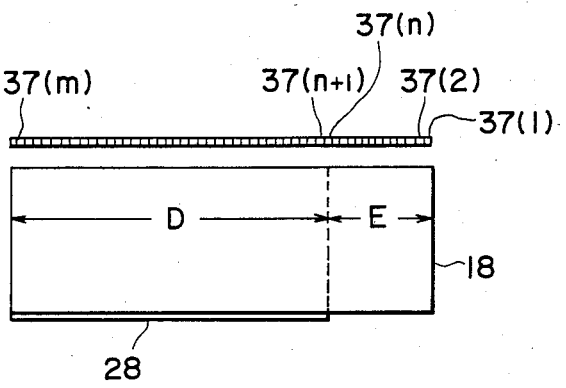
FIG. 7 is a somewhat schematic sectional view of an illumination device according to an embodiment of the present invention.

As shown in FIG. 7, the illumination device 37 comprises a number of LED elements 37(1)–37(m) along the entire width of the photosensitive drum 18. In this embodiment, the photosensitive drum 18 has the imaging area D and the non-imaging area E. The image formed in the imaging area D is transferred onto a copy sheet 5. Among the LED elements, the elements 37(1)–37(n) are lit so as to illuminate the non-imaging area E. By doing so, the electric charge in this area E is erased. Therefore, no toner is deposited on the non-imaging area E. When the size of the copying sheet 5 is changed, the width of the imaging area D, and therefore, the width of the non-imaging area change, accordingly. The illumination device 37 accommodates the change by turning on those LED elements which correspond to the width of the non-imaging area E.

As described above, with a variable magnification copying apparatus, the imaging area varies depending on the finely divided magnification, and therefore, a plurality of the light sources are respectively controlled for the purpose of the blank exposure.

Figure 8:
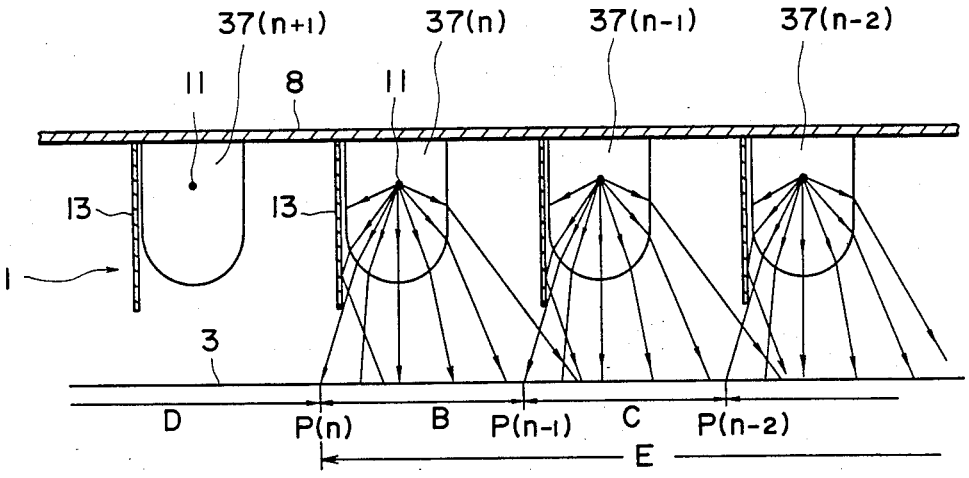
FIG. 8 is an enlarged sectional view of the device shown in FIG. 7.
Figure 9:
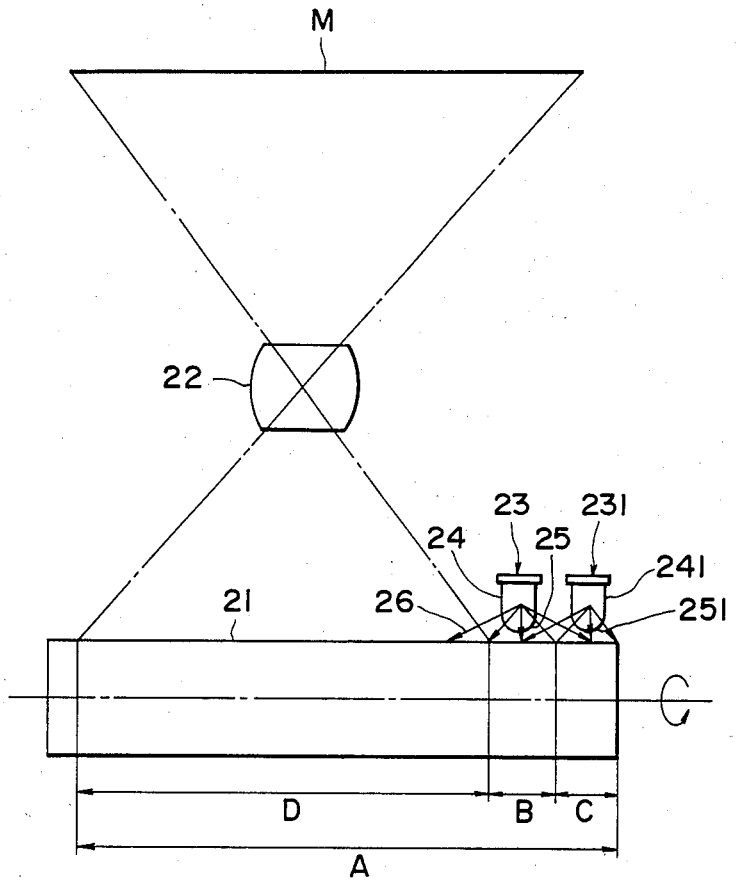
FIG. 9 is a sectional view of a conventional image forming apparatus.
Figure 10:
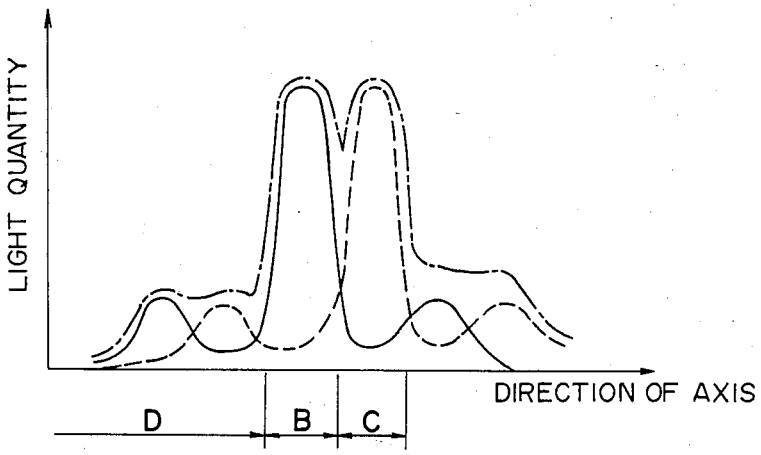
FIG. 10 is a graph illustrating the distribution of the amount of light in the device shown in FIG. 9.

FIG. 8 is an enlarged view of the illumination device used with the apparatus shown in FIGS. 6 and 7. The same reference numerals are assigned to the corresponding elements as in the foregoing embodiments, and the detailed description thereof has been omitted for the sake of simplicity. The following description essentially applies to the foregoing embodiments. In FIG. 8, the LED elements 37(1)–37(n) are lit, and in this case, the boundary between the imaging area D and the non-imaging area E is the line P(n) adjacent to the light blocking member 13. If the LED element 37(n) is turned off, the boundary moves to the position P(n-1); and if the element 37(n-1) is further turned off, the boundary moves to the position P(n-2). The movement of the boundary can accommodate the change of the magnification so as to properly set the blank exposure area.

Since the light blocking member 13 is provided only at such a side as is near to the imaging area, the light emitted from the directive portion of the LED element inclined away from the imaging area D is directly incident on the image bearing member 3 so that it does not go into the imaging area. Additionally, the possible positional error of the LED elements does not influence the illumination of the image bearing member, and therefore, it is substantially negligible on the surface of the photosensitive member. In the case of a zoom copying machine wherein the increment of the variable magnification is 1%, for example, the LED elements are arranged throughout the length of the drum at constant intervals of 3 mm. If the increment is 2%, the interval is 6 mm.

As described above, according to the present invention, the blank exposure can be effected with a sharp boundary with respect to the imaging area, and the possibly scattered light does not go into the imaging area, whereby the image quality adjacent the margin area of the imaging area is very much improved. Additionally, any insufficiency in the amount of light in the middle between the adjacent light sources can be overcome. It is a possible alternative that such a side of the light blocking plate as is facing the associated LED element is treated so as to form a mirror surface, thus positively directing the light reflected thereby toward the non-imaging side, whereby the available quantity of light is increased for the blank exposure.

The foregoing description has been made as using light emitting diodes, but the present invention is applicable to the case where another light source is used if the light source exhibits light directivity as in the light emitting diode. Additionally, the present invention is applicable to apparatus other than copying apparatus, if illumination similar to the blank exposure is used. In addition, the foregoing explanation has been made with the case where one light source is associated with each of the light blocking plates, but the present invention is applicable to the case where a plurality of light sources are used for each of the light blocking plates. In this case, it is preferable to dispose the light sources in a group for each of the light blocking plates, as close as possible so as to avoid non-uniform light quantity distribution.

While the invention has been described with reference to the structures disclosed herein, it is not confined to the details set forth and this application is intended to cover such modifications or changes as may come within the purposes of the improvements or the scope of the following claims.

What is claimed is:

1. An illumination device for use with an image forming apparatus including an image bearing member having an imaging area and a non-imaging area, comprising:

a plurality of light sources disposed opposed to a surface of the image bearing member for removing electric charge from the non-imaging area of the image bearing member, said light sources each having a portion exhibiting a light directivity;

a plurality of light blocking members, each disposed adjacent that side of said light source which is near the imaging area of the image bearing member, for blocking the light emitted from a marginal zone of the light directive portion of the light source but allowing the light emitted from the light directive portion away from the light blocking member to pass, each of said light blocking members having an inclined portion which extends in a direction crossing with a direction perpendicular to the image bearing member.

2. A device according to claim 1, wherein said light sources includes light emitting diodes.

3. A device according to claim 2, wherein a distance $D_3$ measured in a direction perpendicular to the image bearing member between a light emitting source of the light emitting diode and a free end of the light blocking member, and a distance $D_4$ between the free end of the light blocking member and the image bearing member, satisfy $D_3 > D_4$.

4. A device according to claim 1, wherein the light blocking member is disposed adjacent a boundary between the imaging area and the non-imaging area.

5. A device according to claim 1, wherein said light blocking member has a mirrored surface facing the light source.

6. A device according to claim 2, further comprising a member for supporting the light emitting diodes which are integral with the supporting member.

7. A device according to claim 1, wherein said light blocking member extends perpendicularly to the image bearing member.

8. A device according to claim 1, wherein each of said light sources includes a single light emitting element.

9. A device according to claim 1, wherein each of said light sources includes a plurality of light emitting elements.

10. An image forming device, comprising:

an image bearing member having an imaging area and a non-imaging area;

a plurality of light sources disposed opposed to a surface of the image bearing member for removing electric charge from the non-imaging area of the image bearing member, said light sources each having a portion exhibiting a light directivity;

a plurality of light blocking members, each disposed adjacent that side of said light source which is near the imaging area of the image bearing member, for blocking the light emitted from a marginal zone of the light directive portion of the light source but allowing the light emitted from the light directive portion away from the light blocking member to pass, each of said light blocking members having an inclined portion which extends in a direction crossing with a direction perpendicular to the image bearing member.

11. A device according to claim 10, wherein said light sources includes light emitting diodes.

12. A device according to claim 11, wherein a distance $D_3$ measured in a direction perpendicular to the image bearing member between a light emitting source of the light emitting diode and a free end of the light blocking member, and a distance $D_4$ between the free end of the light blocking member and the image bearing member, satisfy $D_3 > D_4$.

13. A device according to claim 10, wherein the light blocking member is disposed adjacent a boundary between the imaging area and the non-imaging area.

14. A device according to claim 10, wherein said light blocking member has a mirrored surface facing the light source.

15. A device according to claim 11, further comprising a member for supporting the light emitting diodes which are integral with the supporting member.

16. A device according to claim 10, wherein said light blocking member extends perpendicularly to the image bearing member.

17. A device according to claim 10, wherein each of said light sources includes a single light emitting element.

18. A device aocording to claim 10, wherein each of said light sources includes a plurality of light emitting elements.

19. An illuminating device for illuminating an image bearing member of an image forming apparatus comprising:

a base plate;

an array of light emitting diodes mounted on said base plate at regular intervals; and a rectangular box-shaped member fixed to said base plate and having a frame and plural light blocking members extending from the frame at the regular intervals, the frame and the light blocking members defining cavities, each cavity containing one of said light emitting diodes, wherein a distance between a light emitting portion of one of said light emitting diodes and an end of an associated light blocking member nearest the image bearing member is larger than a distance between said end of said light blocking member and the image bearing member.

20. A device according to claim 19, wherein said light blocking member has portions inclined from normal to the image bearing member.

* * * * *

UNITED STATES PATENT AND TRADEMARK OFFICE

CERTIFICATE OF CORRECTION

PATENT NO. : 4,728,982

DATED : March 1, 1988

INVENTOR(S) : YUKIO TAKEMURA

It is certified that error appears in the above-identified patent and that said Letters Patent is hereby corrected as shown below:

COLUMN 1

Line 38, "there" should read --thereon--.
Line 52, "Conventionally" should read --Conventionally,--.

COLUMN 2

Line 3, "inventors" should read --the inventor's--.
Line 25, "represent" should read --represents--.

COLUMN 3

Line 34, "non-imaging area" should read --non-imaging areas--.

COLUMN 5

Line 25, "memer 3," should read --member 3,--.
Line 42, "portion 18" should read --portion 15--.

COLUMN 8

Line 16, "includes" should read --include--.
Line 63, "includes" should read --include--.

UNITED STATES PATENT AND TRADEMARK OFFICE

CERTIFICATE OF CORRECTION

PATENT NO. : 4,728,982

DATED : March 1, 1988

INVENTOR(S) : YUKIO TAKEMURA

It is certified that error appears in the above-identified patent and that said Letters Patent is hereby corrected as shown below:

COLUMN 9

Line 19, "aocording" should read --according--.

Signed and Sealed this

Twenty-eighth Day of March, 1989

*Attest:*

DONALD J. QUIGG

*Attesting Officer*

*Commissioner of Patents and Trademarks*